US007159555B2

(12) United States Patent
Nohara et al.

(10) Patent No.: US 7,159,555 B2
(45) Date of Patent: Jan. 9, 2007

(54) START CONTROL FOR INTERNAL COMBUSTION ENGINE

(75) Inventors: Tsuneyasu Nohara, Kanagawa (JP); Yuzou Akasaka, Yokohama (JP); Kazuto Tomogane, Yokohama (JP); Kazutaka Isoda, Yokohama (JP); Makoto Nakamura, Kanagawa (JP); Akinori Suzuki, Kanagawa (JP)

(73) Assignees: Nissan Motor Co., Ltd., Yokohama (JP); Hitachi, Ltd., Tokyo (JP)

( * ) Notice: Subject to any disclaimer, the term of this patent is extended or adjusted under 35 U.S.C. 154(b) by 30 days.

(21) Appl. No.: 11/017,011

(22) Filed: Dec. 21, 2004

(65) Prior Publication Data

US 2005/0139183 A1 Jun. 30, 2005

(30) Foreign Application Priority Data

Dec. 24, 2003 (JP) ..... 2003-426619

(51) Int. Cl.
*F02N 11/00* (2006.01)

(52) U.S. Cl. ..... 123/179.18

(58) Field of Classification Search ..... 123/179.18, 123/90.15–90.18

See application file for complete search history.

(56) References Cited

U.S. PATENT DOCUMENTS

| | | | | |
|---|---|---|---|---|
| 6,257,184 | B1 * | 7/2001 | Yamagishi et al. | 123/90.15 |
| 6,330,869 | B1 * | 12/2001 | Yoshiki et al. | 123/90.15 |
| 6,840,201 | B1 * | 1/2005 | Miura | 123/90.15 |
| 6,917,874 | B1 * | 7/2005 | Uchida et al. | 123/90.15 |
| 2001/0015185 | A1 * | 8/2001 | Ogawa | 123/90.16 |
| 2003/0172888 | A1 * | 9/2003 | Miura | 123/90.16 |

FOREIGN PATENT DOCUMENTS

| | | | |
|---|---|---|---|
| JP | 2000-234533 | A | 8/2000 |
| JP | 2001342856 | A * | 12/2001 |

* cited by examiner

*Primary Examiner*—Stephen K. Cronin
*Assistant Examiner*—Arnold Castro
(74) *Attorney, Agent, or Firm*—Foley & Lardner LLP

(57) ABSTRACT

In an internal combustion engine, a starter motor is energized in response to a request for an engine start to perform a cranking of the internal combustion engine. Thereafter, an electric variable valve motor is energized to control a valve opening/closing characteristic to a condition designed to promote the cranking. The start of the energization of the electric variable valve motor is delayed from the start of the energization of the starter motor at least by a predetermined delay period.

12 Claims, 9 Drawing Sheets

START CONTROL FOR INTERNAL COMBUSTION ENGINE

BACKGROUND OF THE INVENTION

The present invention relates to start control technique for an internal combustion engine having a variable valve operating mechanism to vary a valve opening/closing characteristic.

Internal combustion engines have been provided with various variable valve operating mechanisms to vary a valve opening/closing characteristic in accordance with an operating condition of the engine and thereby to improve a fuel economy at a low-revolution/light-load operation and an output torque at a high-revolution/heavy-load operation. Japanese Patent Application Publication No. 2000-234533 discloses a variable lift/angle mechanism capable of continuously varying both a valve lift amount and an operative angle of each intake valve.

SUMMARY OF THE INVENTION

Upon an engine start, i.e., when a crankshaft is cranked by an electric starter motor, high frictions are generated at parts of the engine. The high frictions originate from such factors as a low engine speed, and an incapability of an oil pump to sufficiently perform a forcible lubrication inside the engine because of high viscosity of a lubricating oil. In order to achieve a favorable engine startability in spite of the high frictions being generated, a sufficient cranking torque and a sufficient combustion torque to overcome the high frictions are required. In order to achieve the sufficient cranking torque, a large electric current (power) needs to be supplied from a power source battery to the starter motor. On the other hand, to achieve the sufficient combustion torque depends greatly upon an intake lift characteristic, especially a closing timing of the intake valve, determined by the above-mentioned variable valve operating mechanism.

When the closing timing of the intake valve is at an advance angle from a bottom dead center of a piston, such as in a case of the intake lift characteristic being small-lift/small-angle at the engine start with a small valve lift amount and a small operative angle, the intake valve is closed before an air-fuel mixture is sufficiently supplied to a combustion chamber, and thereby reduces an air-fuel mixture charge. This results in a small combustion torque. With this small combustion torque, the high frictions at parts of the engine cannot be overcome to increase the engine speed, and thereby may cause an engine stall. When the closing timing of the intake valve is at a retard angle from the bottom dead center, such as in a case of the intake lift characteristic being large-lift/large-angle at the engine start, the air-fuel mixture once taken in the combustion chamber is discharged to an intake passage after the bottom dead center, and thereby reduces an air-fuel mixture charge in the combustion chamber. Therefore, as in the case of the small-lift/small-angle characteristic, a sufficient combustion torque cannot be achieved, and thereby aggravates the engine startability. Especially, in the case of the large-lift/large-angle characteristic, since frictions in a valve operating system are high, the engine startability is aggravated also in this respect. When the closing timing of the intake valve is in proximity of the bottom dead center, such as in a case of the intake lift characteristic being medium-lift/medium-angle at the engine start, an air-fuel mixture charge in the combustion chamber is large. This results in a large combustion torque. With this large combustion torque, the internal combustion engine can overcome the high frictions at parts of the engine, and can increase the engine speed. Thereby the internal combustion engine can quickly secure a stable combustion condition, and thus can achieve a favorable engine startability.

At this point, the valve opening/closing characteristic in an engine stop state is influenced by such factors as a spring force of a valve spring and a reaction force from the valve operating system, and thereby is inevitably approximated to a minimum-lift characteristic. Therefore, upon the engine start, it is preferred that an electric variable valve motor is energized, and thereby the variable valve operating mechanism is activated to change the intake lift characteristic to the medium-lift/medium-angle characteristic which is suitable for the engine start.

However, at an early stage of the engine start corresponding approximately to one revolution of the cranking by the starter motor, a considerably large cranking torque is necessary to transfer a stop state of the crankshaft into a rotational state. Therefore, if the variable valve motor is energized concurrently with the starter motor being energized to start the cranking, consumption current (power) temporarily undergoes a sharp increase. This causes a shortage in electric supply to the starter motor and a failure to achieve the desired cranking torque, and may deteriorate the engine startability.

The heretofore-described problems do not occur only to the variable lift/angle mechanism which variably controls the valve lift amount and the operative angle; but similar problems may occur to variable valve operating mechanisms arranged to control rotational phases of a crankshaft and a camshaft in accordance with an engine operating condition, because the rotational phases involve both suitable and not suitable opening/closing timings of intake valve for the engine start.

It is an object of the present invention to provide technique for controlling a valve opening/closing characteristic to a state suitable for cranking at an engine start, by using a variable valve operating mechanism, without causing an excessively sharp increase in power consumption by a variable valve motor and a starter motor.

According to one aspect of the present invention, a start control apparatus for an internal combustion engine, includes: a cranking actuating section to perform an energization of a starter motor in response to a request for an engine start and thereby perform a cranking of the internal combustion engine; a valve operation start control section to perform an energization of an electric variable valve motor and thereby activate a variable valve operating mechanism to control a valve opening/closing characteristic to a condition designed to promote the cranking; and a delay control section to delay a timing of starting the energization of the electric variable valve motor from a timing of starting the energization of the starter motor at least by a predetermined delay period.

The other objects and features of this invention will become understood from the following description with reference to the accompanying drawings.

DETAILED DESCRIPTION OF THE INVENTION

Figure 1:
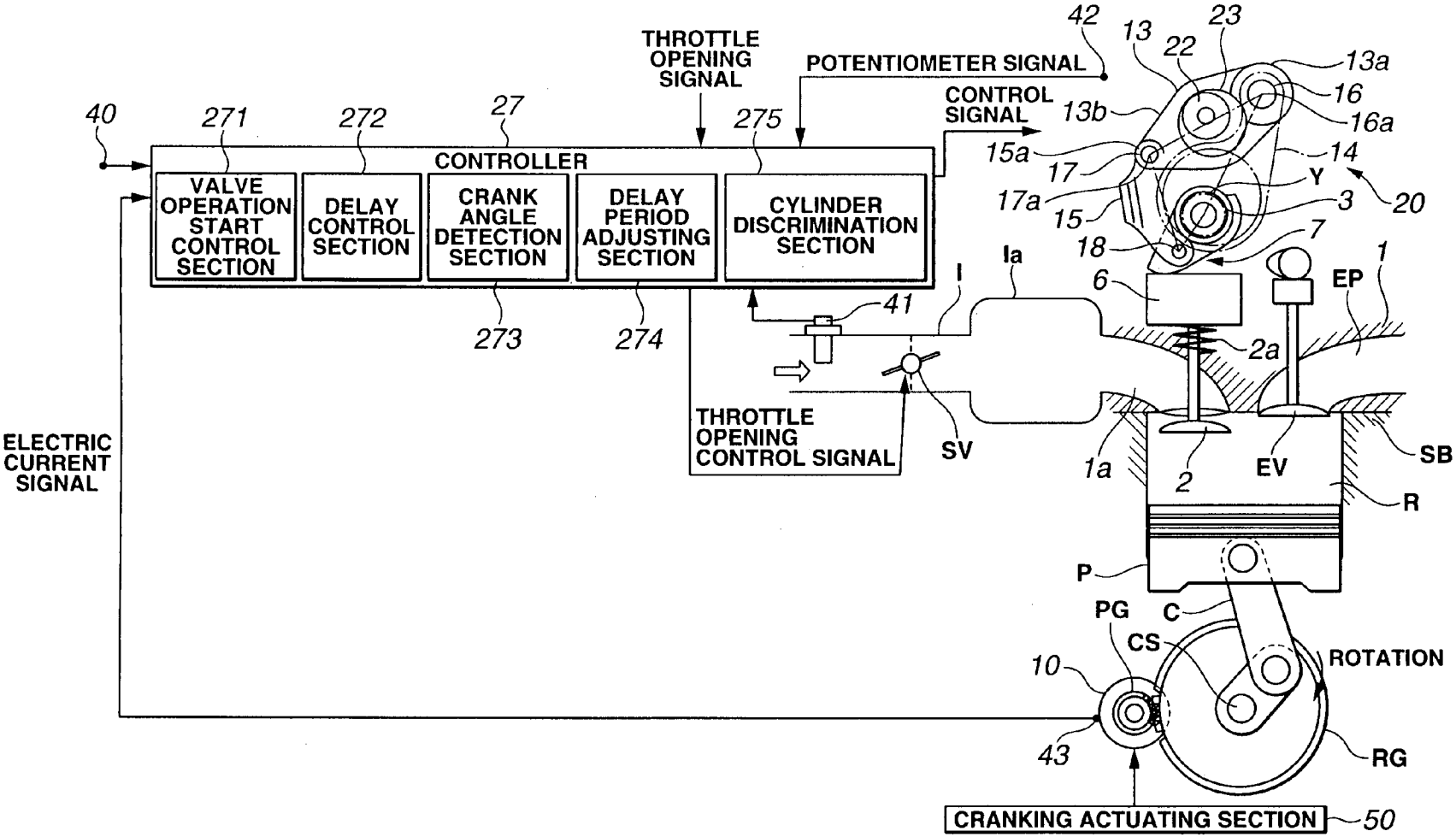
FIG. 1 is a schematic view showing an internal combustion engine using a start control system according to the present invention.
Figure 2:
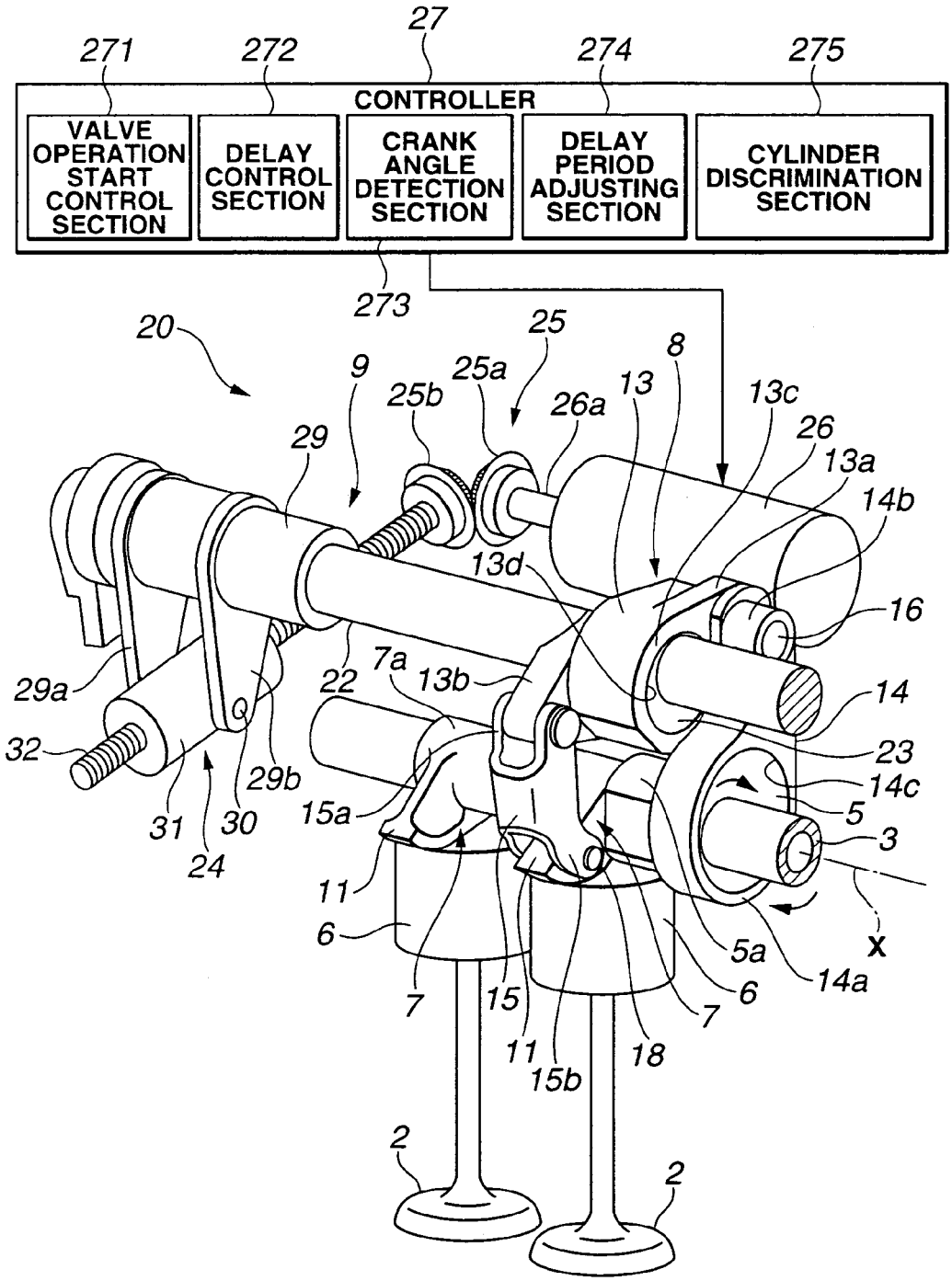
FIG. 2 is a perspective view showing an example of a variable valve operating mechanism used in the internal combustion engine of FIG. 1.

FIG. 1 is a schematic view showing an internal combustion engine using a start control system or apparatus according to an embodiment of the present invention. FIG. 2 is a perspective view showing an example of a variable valve operating mechanism used in the internal combustion engine of FIG. 1. The internal combustion engine of this example is an inline four-cylinder four-cycle internal combustion engine including two intake valves per cylinder. As show in FIGS. 1 and 2, the internal combustion engine includes a cylinder block SB, a cylinder head 1, a piston P, an intake pipe I, a pair of intake valves 2 and a variable valve operating mechanism or system (a variable lift/angle mechanism or system) 20. A combustion chamber R is defined and thus surrounded by cylinder block SB, cylinder head 1 and piston P. Cylinder head 1 is formed with an intake port 1*a*. Intake pipe I supplies an intake air to combustion chamber R via intake port 1*a*. Intake valves 2 are each provided slidably on cylinder head 1 by a valve guide, and biased by spring forces of valve springs 2*a* toward directions of closing the valves. Variable valve operating mechanism 20 variably controls a valve lift amount and an operative angle of intake valves 2 continuously in accordance with changes in an operating condition of the engine. Intake pipe I includes a throttle valve SV to control an intake air amount to be supplied to combustion chamber R.

The internal combustion engine of FIG. 1 also includes a crankshaft CS, a connecting rod C, an electric starter motor 10 and a cranking control or actuating section 50. Cylinder block SB is formed with a cylinder bore. Cylinder bore receives piston P slidably in vertical directions. Piston P is connected with crankshaft CS by connecting rod C. Cylinder head 1 is formed with an exhaust port EP on an opposite side from intake port 1*a*. The internal combustion engine of FIG. 1 also includes an exhaust valve EV to open and close exhaust port EP. Exhaust valve EV is biased by a valve spring toward a direction of closing the valve. Intake pipe I includes a surge tank Ia to subdue an intake pulsation, and an air flowmeter 41 to sense an intake air flow. Air flowmeter 41 is provided upstream of throttle valve SV.

Figure 3:
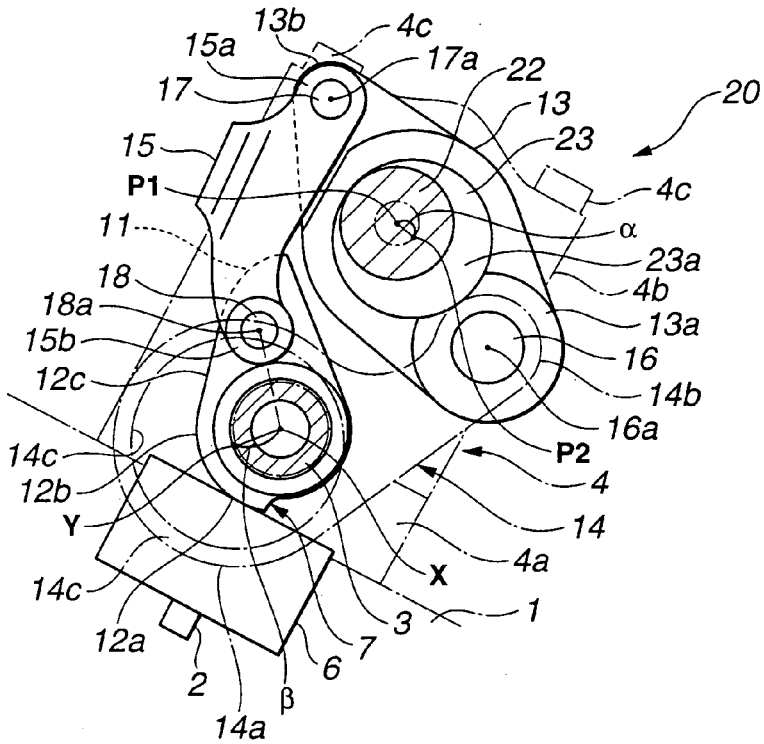
FIG. 3 is a sectional view showing a valve closing state under a minimum-lift control by the variable valve operating mechanism of FIG. 2.

FIG. 3 is a sectional view showing a valve closing state under a minimum-lift control by the variable valve operating mechanism of FIG. 2. As show in FIGS. 1~3, variable valve operating mechanism 20 includes a tubular drive shaft 3, a drive cam 5, a pair of oscillating cams 7, a transmission mechanism 8, and a control or actuating mechanism 9. Drive shaft 3 is supported rotatably on a shaft bearing 4 provided on an upper part of cylinder head 1. Drive cam 5 is fixed to drive shaft 3 by such a process as press fit. Oscillating cams 7 are supported on the circumference of drive shaft 3 so that each of oscillating cams 7 swings around drive shaft 3 and slides on an upper surface of one of valve lifters 6 to open one of intake valves 2. Each of valve lifters 6 is provided on an upper end of one of intake valves 2. Transmission mechanism 8 links drive cam 5 with oscillating cams 7, and converts a turning force of drive cam 5 to oscillating forces (valve opening forces) of oscillating cams 7. Actuating mechanism 9 variably controls an operating position of transmission mechanism 8.

Drive shaft 3 extends in a longitudinal direction of variable valve operating mechanism 20. The longitudinal direction of variable valve operating mechanism 20 in this example is coincident with a longitudinal direction of the internal combustion engine. Drive shaft 3 receives a turning force from crankshaft CS via elements not shown in the figure, such as a driven sprocket wheel provided at one end of drive shaft 3, and a timing chain wound around the driven sprocket wheel. Upon an engine start, cranking control or actuating section 50 energizes starter motor 10, and crankshaft CS is cranked and rotated by starter motor 10 via a pinion gear PG and a ring gear RG, as shown in FIG. 1.

As shown in FIGS. 2 and 3, drive cam 5 is made of an abrasion-resistant material in a substantially circular form, and is formed with an insertion hole extending through drive cam 5 inwardly in an axial direction to receive drive shaft 3. Drive cam 5 has a center Y offset from an axis X of drive shaft 3 by a predetermined distance β in a radial direction. Drive cam 5 includes a tubular portion 5*a* extending inwardly in the axial direction. Drive shaft 3 extends through the insertion hole and tubular portion 5*a*. Drive cam 5 is fixed with drive shaft 3 by a coupling pin passing through tubular portion 5*a* and drive shaft 3 in a diametrical direction. Each of valve lifters 6 has a closed-end cylindrical form, and is slidably held in a holding hole formed in cylinder head 1. The upper surface of each of valve lifters 6 has a flat form. Each of oscillating cams 7 is slid on the flat upper surface of one of valve lifters 6.

Each of oscillating cams 7 has an equal profile in a raindrop form, and includes a base portion and a cam nose portion 11. Cam nose portion 11 projects radially outward from the base portion. Oscillating cams 7 share a tubular portion 7*a* connecting the base portions. Tubular portion 7*a* is formed with a support hole extending through tubular portion 7*a* inwardly in an axial direction to receive drive shaft 3. Oscillating cams 7 are swingablly supported on drive shaft 3 extending through the support hole. One of cam nose portions 11 is formed with a pin hole extending through the cam nose portion 11 to receive a pin 18. As shown in FIGS. 2 and 3, each of oscillating cams 7 has an underside cam surface composed of a base circle face 12*a*, a ramp face 12*b* and a lift face 12*c*. Base circle face 12*a* forms a base circle of the base portion connected with tubular portion 7*a*. Ramp face 12*b* has an arc form extending from base circle face 12*a* and continuing to cam nose portion 11. Lift face 12*c* continues from ramp face 12*b* to a top face for a maximum lift which is located at an end of cam nose portion 11. Either of base circle face 12*a*, ramp face 12*b*, lift face 12*c* and the top face contacts a predetermined position of the upper surface of each of valve lifters 6 in accordance with a swinging position of oscillating cam 7, and thereby varies a valve lift characteristic of each of intake valves 2. When the top face contacts the upper surface of each of valve lifters 6, the valve lift characteristic assumes a maximum-lift characteristic.

Transmission mechanism 8 includes a rocker arm 13, a link arm 14 and a link member 15, as shown in FIGS. 2 and 3. Rocker arm 13 is disposed above drive shaft 3, and includes a first end or one end 13*a*, a second end or other end 13*b*, and a cylindrical base portion 13*c*. First end 13*a* projects outward in a first or one direction from base portion 13*c*. Second end 13*b* projects outward in a second or other direction from base portion 13*c*. Base portion 13*c* is formed with a support hole 13*d* extending through base portion 13*c* in an axial direction. Link arm 14 links first end 13*a* with drive cam 5. Link member 15 links second end 13*b* with one of oscillating cams 7 including cam nose portion 11 formed with the pin hole. A control or actuating cam 23 of actuating mechanism 9 is fit in support hole 13*d* of base portion 13*c*. Thus, rocker arm 13 is supported rotatably on actuating cam 23. First end 13*a* is formed with a pin hole extending through first end 13*a* to receive a pin 16 connecting with link arm 14. Second end 13*b* is formed with a pin hole extending through second end 13*b* to receive a pin 17 connecting with link member 15. Link arm 14 includes a base portion 14*a* at a first or one end, and a projecting end portion 14*b* at a second or other end. Base portion 14*a* has a substantially circular form having a relatively large diameter. Projecting end portion 14*b* projects from a predetermined position on the circumference of base portion 14*a*. Base portion 14*a* is formed with a fit hole 14*c* at a middle position to fit rotatably over the circumference of drive cam 5. Projecting end portion 14*b* is formed with a pin hole extending through projecting end portion 14*b* to rotatably receive pin 16. Pin 16 has an axis 16*a* which is coincident with an axis of the pin hole of first end 13*a* of rocker arm 13. Link member 15 is formed by bending into a shape having a substantially U-shaped cross section, and includes first and second ends 15*a* and 15*b* at both ends. First and second ends 15*a* and 15*b* are connected rotatably with second end 13*b* and cam nose portion 11 by pins 17 and 18, respectively. Thus, link member 15 links second end 13*b* of rocker arm 13 with cam nose portion 11 of oscillating cam 7.

Actuating mechanism 9 includes a control or actuating shaft 22, actuating cam 23, a direct-current variable valve motor 26, and a controller 27, as shown in FIGS. 1~3. Actuating shaft 22 is disposed above drive shaft 3 and supported rotatably on shaft bearing 4. Actuating cam 23 is fixed with the circumference of actuating shaft 22, and supports rocker arm 13 rotatably or swingabily. Variable valve motor 26 is an electric actuator, which is connected with actuating shaft 22 via a ball screw mechanism 24 and a gear mechanism 25. Variable valve motor 26 controls rotation of actuating shaft 22. Controller 27 controls actuation of variable valve motor 26. Actuating shaft 22 extends in the longitudinal direction of the engine in parallel with drive shaft 3. Actuating cam 23 has a cylindrical form, which is formed with an eccentric hole extending through actuating cam 23 to receive actuating shaft 22, and includes a radially thick portion 23*a* opposite the eccentric hole. Thus, actuating cam 23 has an axis P2 biased from an axis P1 of actuating shaft 22 by a predetermined distance a due to thick portion 23*a*, as shown in FIG. 3. Ball screw mechanism 24 includes a cylindrical portion 29, a pair of levers 29*a* and 29*b*, a cylindrical nut portion 31 and α threaded rod 32, as shown in FIG. 2. Cylindrical portion 29 is fixed to one end of actuating shaft 22. Levers 29*a* and 29*b* each project radially outward from cylindrical portion 29. Cylindrical nut portion 31 extends in a direction perpendicular to the axis of actuating shaft 22 through a gap between ends of levers 29*a* and 29*b*, and is supported rotatably between the ends of levers 29*a* and 29*b* by a pin 30. Cylindrical nut portion 31 is formed with a hole extending through cylindrical nut portion 31, the hole being formed with an internal screw groove in an inside surface. Threaded rod 32 extends through the hole of cylindrical nut portion 31, and is engaged with the internal screw groove of the hole. Gear mechanism 25 includes two bevel gears 25*a* and 25*b*. Variable valve motor 26 includes a drive shaft 26*a* extending from one end of variable valve motor 26. Bevel gears 25*a* and 25*b* are coupled respectively with an end of drive shaft 26*a* and an end of threaded rod 32, and are engaged perpendicularly with each other.

Controller 27 includes microcomputer-based sections to detect an operating condition of the engine in accordance with detection signals from various sensors including a crank angle sensor 40, air flowmeter 41, a coolant (water) temperature sensor and a throttle opening sensor, and to output a control signal to variable valve motor 26 of variable valve operating mechanism 20 in accordance with a detection signal from a potentiometer 42 for sensing a rotational position of actuating shaft 22, as shown in FIG. 1. In this example, the microcomputer of controller 27 performs a computing operation to detect the operating condition. Starter motor 10 includes an electric current sensor 43 to sense an electric current supplied to starter motor 10. Controller 27 detects an electric current value from an electric current signal supplied from electric current sensor 43.

Figure 4:
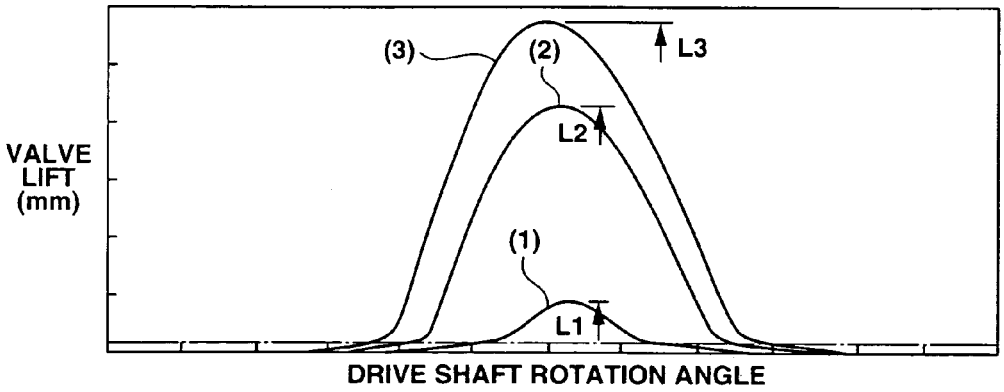
FIG. 4 is a diagram showing valve lift characteristics achieved by the variable valve operating mechanism of FIG. 2.

FIG. 4 is a diagram showing valve lift characteristics achieved by the variable valve operating mechanism of FIG. 2. At a low-speed/light-load operation of the engine, a valve lift amount L1 and an operative angle are set to sufficiently small values as a small-lift/angle characteristic, as represented by a valve lift curve (1) in FIG. 4. This small-lift/angle characteristic involves low frictions, and delays an opening timing of each of intake valves 2 to reduce a valve overlap with the exhaust valve. Therefore, the internal combustion engine of this embodiment can achieve an improved fuel economy and a stable engine rotation. At a medium-speed/medium-load operation of the engine, a valve lift amount L2 and an operative angle are set to medium values, as represented by a valve lift curve (2) in FIG. 4. Specifically, in this setting, an opening timing of the intake valve (IVO) is set in proximity of an exhaust top dead center, and a closing timing of the intake valve (IVC) is set in proximity of a bottom dead center. At a high-speed/heavy-load operation of the engine, a valve lift amount L3 and an operative angle are set to large values, as represented by a valve lift curve (3) in FIG. 4. This setting advances the opening timing of each of intake valves 2, and delays the closing timing of each of intake valves 2. Therefore, the internal combustion engine of this embodiment can achieve an improved intake air charging efficiency and secure a sufficient engine output.

Figure 5:
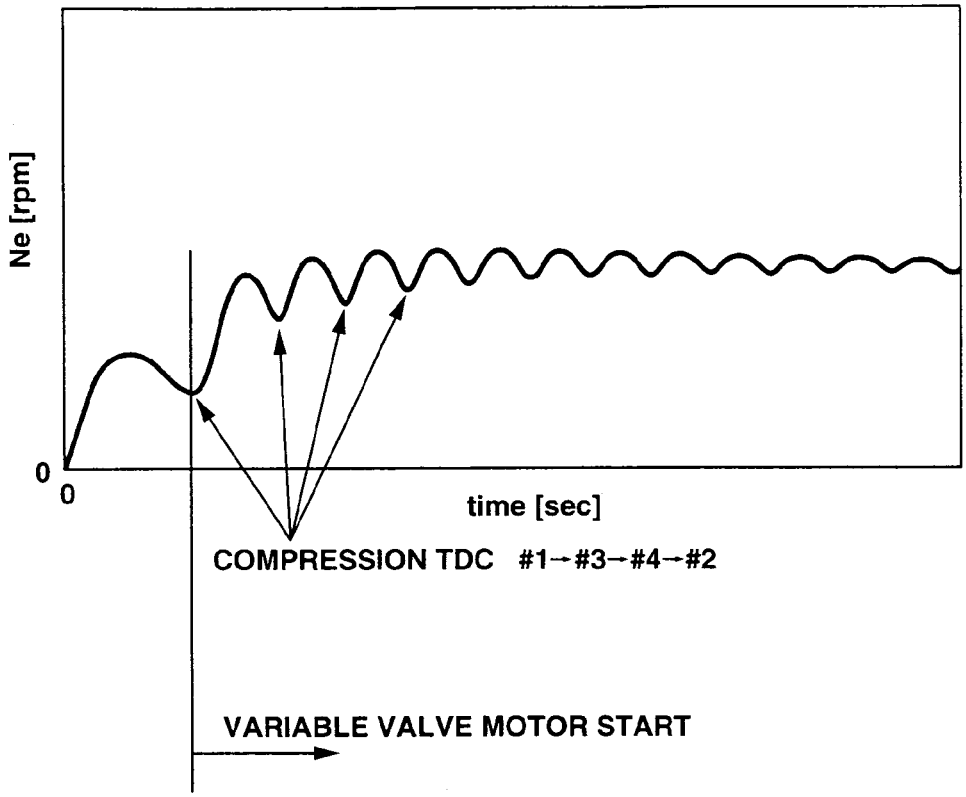
FIG. 5 is a diagram showing changes in engine revolutions from a timing immediately after engine start.

Next, a description will be given of an engine start control by the start control system of the internal combustion engine of this embodiment. FIG. 5 is a diagram showing changes in engine revolutions after a start of the cranking by starter motor 10 at the engine start. As shown in FIG. 5, in proximity of a compression top dead center (compression TDC) of each of four cylinders #1~#4, the number of engine revolutions temporarily decreases, and a current consumed by starter motor 10 temporarily increases, because of maximum load for compressing air in the combustion chamber of the cylinder. Especially when one of the cylinders reaches the compression top dead center for the first time, the current/power consumed by starter motor 10 becomes maximum, because the number of engine revolutions is still small at the first compression top dead center. Generally, in a four-cylinder internal combustion engine, ignition is caused in cylinders #1~#4 in an order of #1, #3, #4 and #2. However, which of cylinders #1~#4 is the first to reach the compression top dead center depends on a position at which the crankshaft is stopped in an engine top state.

Figure 6:
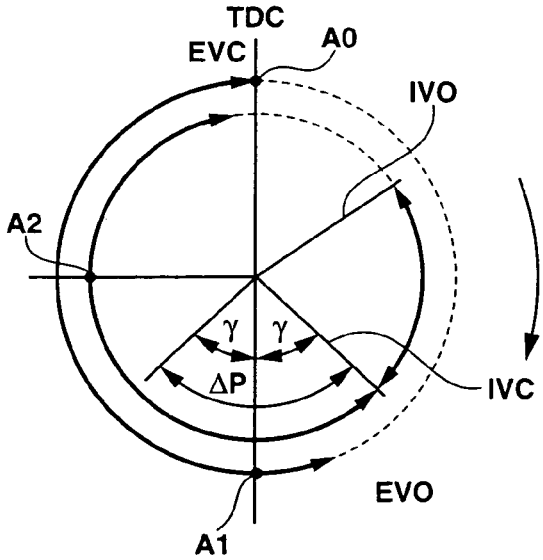
FIG. 6 is a diagram showing valve timings of an intake valve and an exhaust valve in an engine stop state.

FIG. 6 is a diagram showing valve timings of the intake valve and the exhaust valve in an engine stop state. As shown in FIG. 6, the exhaust valve of this embodiment has a fixed valve lift characteristic in which an opening timing of the exhaust valve (EVO) is set at an advance angle slightly from the bottom dead center, and a closing timing of the exhaust valve (EVC) is set in proximity of the exhaust top dead center. The valve lift characteristic of each of intake valves 2 is variable; however, each of intake valves 2 becomes stable at a minimum-lift/angle state in the engine stop state. Specifically, each of oscillating cams 7 at a lifting position is biased or pressed up by spring forces of valve springs 2*a* in the engine stop state, and this bias force varies the position of variable valve operating mechanism 20 including transmission mechanism 8 and actuating mechanism 9 (including actuating cam 23) toward a direction of lowering the lift amount. That is, as shown in FIG. 6, in the engine stop state, the lift characteristic of each of intake valves 2 soon becomes stable at the minimum-lift/angle state. In this minimum-lift/angle state, the opening timing of the intake valve is at a retard angle largely from the exhaust top dead center, and the closing timing of the intake valve is at an advance angle largely from an intake bottom dead center (intake BDC).

To improve a combustion stability and a combustion torque at the engine start, it is desirable that the closing timing of the intake valve (IVC) is in proximity of the intake bottom dead center, as mentioned above. Therefore, it is preferred that variable valve motor 26 is energized at a timing according to the cranking by starter motor 10, and thereby variable valve operating mechanism 20 is activate to change or control the lift/angle characteristic to assume a predetermined medium-lift/angle characteristic in which a valve lift amount and an operative angle are set to target medium values suitable for the engine start so that the IVC is set in proximity of the intake bottom dead center. However, if variable valve motor 26 is energized concurrently with the cranking by starter motor 10, electric power consumed by starter motor 10 and variable valve motor 26 temporarily undergoes a sharp increase, and thereby may cause a faulty engine start, or may lead to an increase in capacity of a battery resulting in a size increase of the battery.

Figure 7:
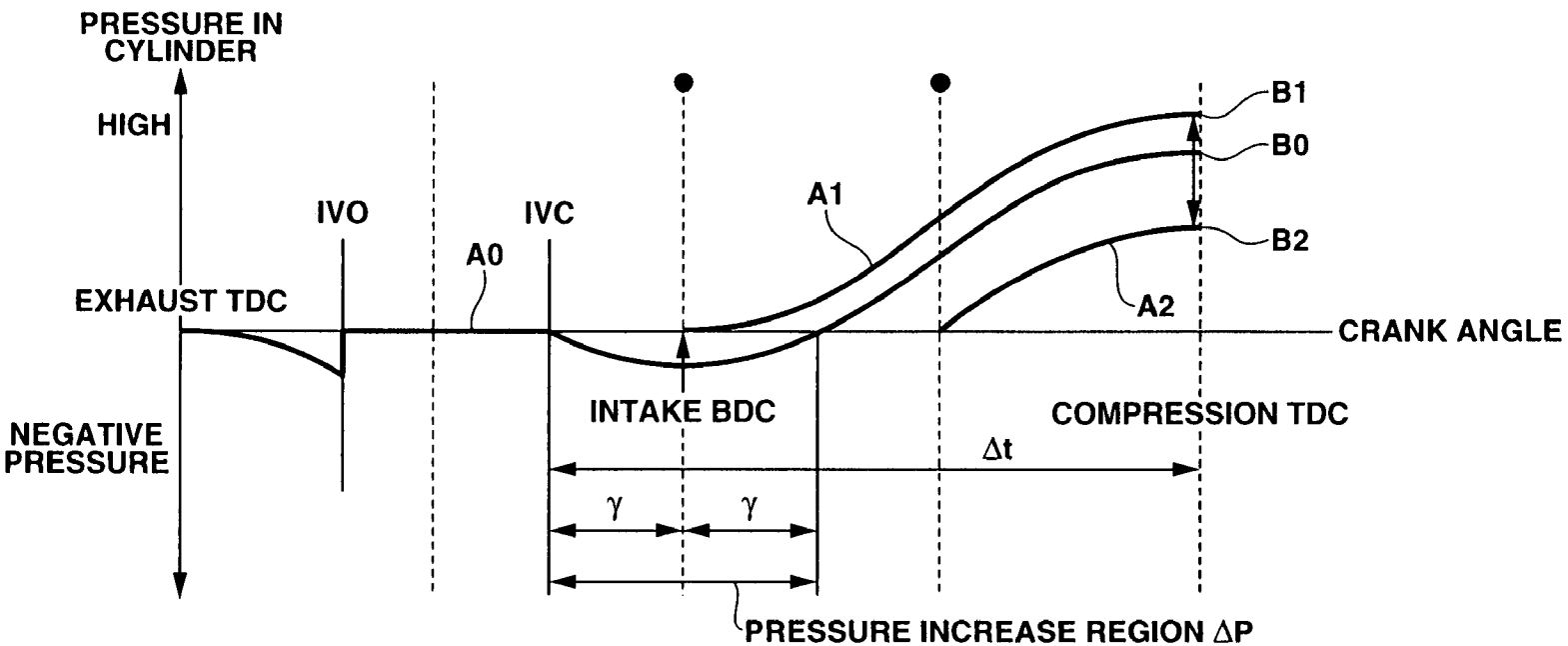
FIG. 7 is a time chart showing changes in pressure in a cylinder after engine start.

The electric power consumed by starter motor 10 and variable valve motor 26 may be further increased, especially when a pressure in the cylinder may become high, and thereby a cranking torque may be increased, depending on a crank angle, i.e., a piston position in each of the cylinders, in an engine stop state. Characteristics of the pressure in the cylinder at an early stage of the start of the cranking after the engine stop state can be classified into three patterns in accordance with the crank angle (the piston position in each of the cylinders), as described in the following. FIG. 7 is a time chart showing changes in the pressure in the cylinder after an engine start.

Firstly, in a case where the piston position in an engine stop state is in a reference region including an exhaust stroke and an expansion stroke, the characteristic of the pressure in the cylinder after the start of the cranking assumes a reference characteristic A0 of FIG. 7. According to reference characteristic A0, a negative pressure in the cylinder develops as the piston descends in a period from an exhaust top dead center (exhaust TDC) to an opening of the intake valve (IVO). When the intake valve opens, the pressure in the cylinder is recovered to a pressure substantially equal to atmospheric pressure (a pressure equivalent to a pressure in the intake pipe). The intake valve closes before an intake bottom dead center (intake BDC). Therefore, a negative pressure in the cylinder develops in a period from the closing of the intake valve (IVC) to the intake BDC. After the intake BDC, the pressure in the cylinder is recovered as the piston ascends, and becomes equivalent to the atmospheric pressure at an angle advanced from the intake BDC by a crank angle $\gamma$ which is equal to an angle from the IVC to the intake BDC. Thereafter, the pressure increases until a compression top dead center (compression TDC), and becomes a reference maximum pressure B0 (a reference value of maximum pressure) at the compression TDC. Besides, in a case where the piston position in an engine stop state is in a period from the exhaust TDC to the IVC in an intake stroke, a maximum pressure also equals reference value B0.

Figure 8A:
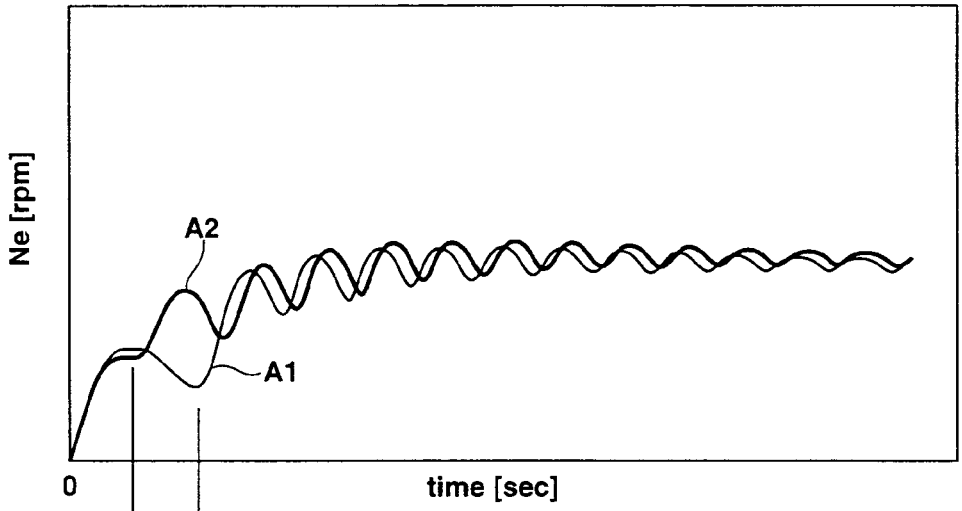
FIGS. 8A and 8B are diagrams respectively showing changes in engine revolutions, and changes in torque required by a starter motor, after engine start.
Figure 8B:
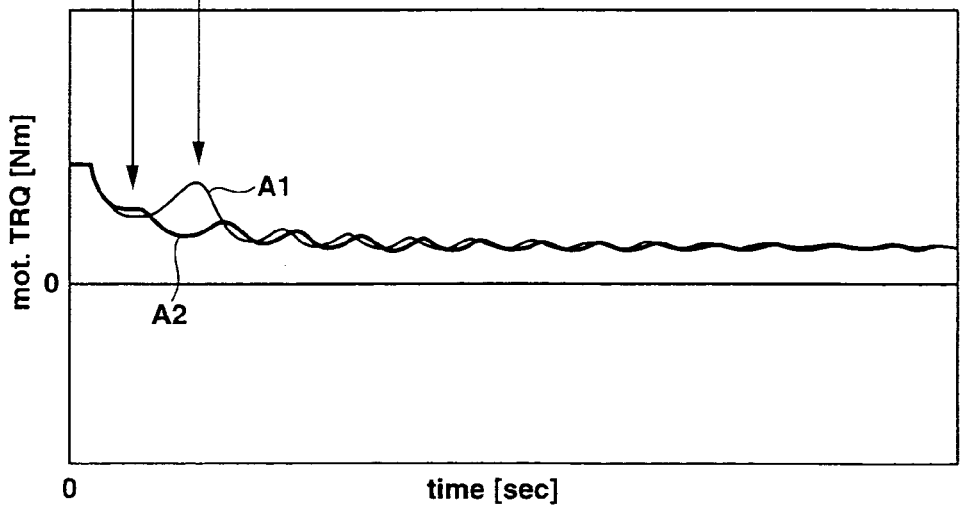

Secondly, in a case where the piston position in an engine stop state is in a pressure increase region $\Delta P$ in proximity of the intake BDC, the characteristic of the pressure in the cylinder represents a characteristic A1 of FIG. 7. Pressure increase region $\Delta P$ is equivalent to a region from the IVC to a timing corresponding to the angle advanced from the intake BDC by crank angle $\gamma$. For example, assuming that the IVC is 150° after compression TDC (ATDC 150°), pressure increase region $\Delta P$ is ATDC 150°~210°. In this case, the pressure in the cylinder is a negative pressure in a state immediately after an engine stop. However, the pressure in the cylinder is gradually recovered from the negative pressure during the engine stop, and soon becomes equivalent to the atmospheric pressure. Consequently, according to characteristic A1, a maximum pressure B1 in the cylinder at the compression TDC becomes higher than reference maximum pressure B0, as shown in FIG. 7. Therefore, starter motor 10 is required to produce a larger cranking torque as shown in FIG. 8B, and thereby electric current or power consumed by starter motor 10 temporarily increases. FIG. 8A is a diagram showing changes in engine revolutions after an engine start. FIG. 8B is a diagram showing changes in torque required by starter motor 10 after the engine start.

Thirdly, in a case where the piston position in an engine stop state is in middle and latter stages of a compression stroke, specifically, during the compression stroke except pressure increase region $\Delta P$, the characteristic of the pressure in the cylinder represents a characteristic A2 of FIG. 7. In this case, the pressure in the cylinder is high in a state immediately after an engine stop. However, the pressure in the cylinder is gradually decreased during the engine stop, and soon becomes equivalent to the atmospheric pressure. Since the compression starts from this point, a maximum pressure B2 in the cylinder at the compression TDC becomes lower than reference maximum pressure B0 according to characteristic A2, as shown in FIG. 7. Therefore, starter motor 10 is required to produce a relatively small cranking torque as shown in FIG. 8B, and thereby electric power consumed by starter motor 10 is held low.

Thus, when the piston position in an engine stop state is within pressure increase region $\Delta P$, maximum pressure B1 becomes higher than reference maximum pressure B0. Especially when the piston position in an engine stop state is at the intake BDC, maximum pressure B1 becomes highest.

When the piston position in an engine stop state is at an advance angle side from pressure increase region ΔP, the maximum pressure is held to reference value B0, and a crank angle to the compression TDC is large. Therefore, the number of engine revolutions is already large at the compression TDC, and starter motor 10 requires a relatively small electric power.

Figure 9:
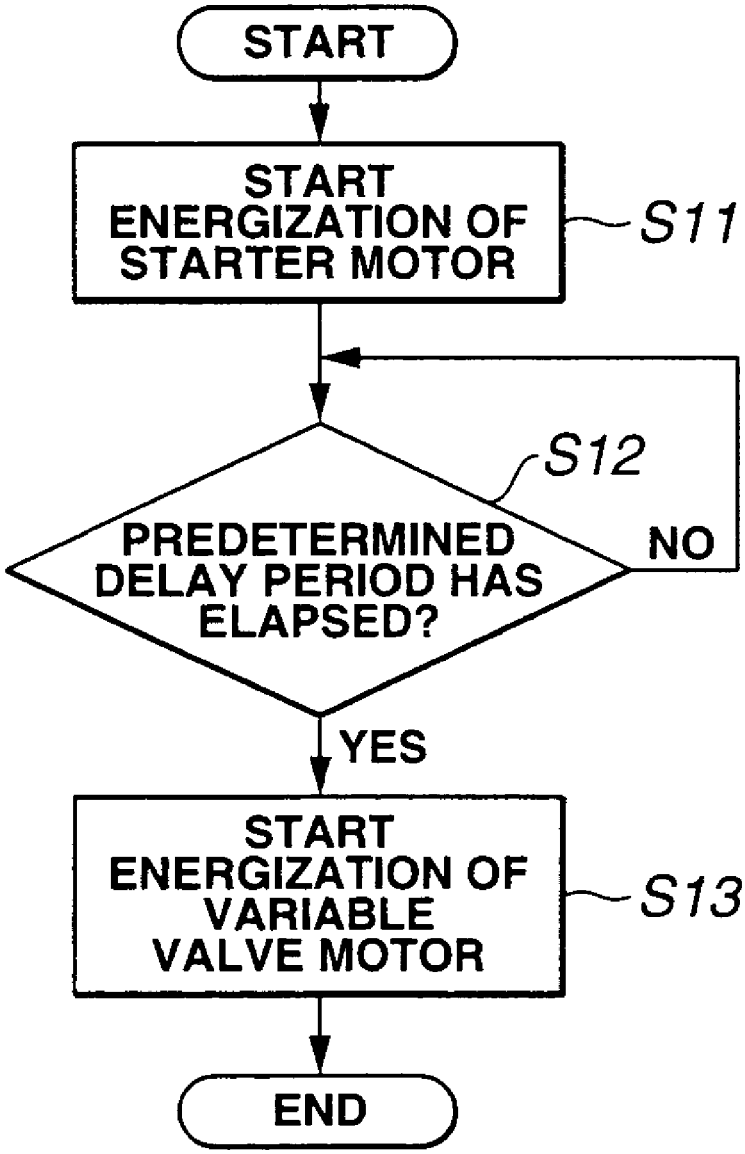
FIG. 9 is a flowchart showing an engine start control according to a first embodiment of the present invention.

FIG. 9 is a flowchart showing an engine start control according to a first embodiment of the present invention. This routine is performed in response to an engine start request made by engine start request input means, such as an operation of an ignition key. First, in step S11, an electric supply to starter motor 10 is started in response to the engine start request, and thus rotation of crankshaft CS by starter motor 10, i.e., cranking and engine start, is commenced (cranking part). In S12, it is determined whether or not a predetermined delay period corresponding to a crank angle Δt from an IVC to a compression TDC has elapsed since the start of the electric supply to starter motor 10. This delay period is equivalent to a period required by crankshaft CS to rotate by crank angle Δt from the start of the cranking, i.e., a period from the IVC to the compression TDC with a valve opening/closing characteristic for an engine stop state, and thus is a fixed value which is determined and stored beforehand. When it is determined in S12 that the predetermined delay period has elapsed since the start of the electric supply to starter motor 10, the routine of FIG. 9 proceeds to S13. In S13, an electric supply to variable valve motor 26 is started. Thereby, variable valve operating mechanism 20 is activated to control a valve lift characteristic of each of intake valves 2 to assume a predetermined medium-lift/angle characteristic (in which the IVC is set in proximity of an intake bottom dead center) suitable for the cranking (valve operation start control part). In the example in FIGS. 1 and 2, controller 27 includes a valve operation start control section 271 and a delay control section 272. Valve operation start control section 271 is arranged to energize variable valve motor 26, and thereby activate variable valve operating mechanism 20 to control the valve lift characteristic or valve opening/closing characteristic to a state suitable for the cranking. Delay control section 272 is arranged to delay the start of energization of electric variable valve motor 26 from the start of energization of starter motor 10 until the predetermined delay period has elapsed, or at least by the predetermined delay period. In this embodiment, at least cranking control or actuating section 50, valve operation start control section 271 and delay control section 272 form the start control system or apparatus of the present invention.

Thus, according to this first embodiment, the timing of the electric supply to variable valve motor 26 is delayed from the start of the electric supply to starter motor 10 by the predetermined delay period (delay control part). With this delay, variable valve operating mechanism 20 changes the valve lift characteristic of each of intake valves 2 to assume the predetermined medium-lift/angle characteristic suitable for the cranking. Thereby, the internal combustion engine of this embodiment can have an improved combustion stability and combustion torque upon the engine start without energizing variable valve motor 26 concurrently with starter motor 10 at least in a state where a maximum pressure upon the engine start exceeds reference maximum pressure B0. Thus, the internal combustion engine of this embodiment can avoid an excessive increase in electric power to be consumed by starter motor 10 and variable valve motor 26, and thus can secure a stable engine startability without causing a faulty engine start.

In the following embodiments, a crank angle location in an engine stop state is detected and stored in the engine stop state, or a crank angle location in an engine stop state is detected immediately after an engine start, in accordance with detection signals from sensors including crank angle sensor 40. Then, in accordance with the crank angle location in the engine stop state, the delay period is adjusted (delay period adjusting part). In the example in FIGS. 1 and 2, controller 27 also includes a crank angle detection section 273 and a delay period adjusting section 274. Crank angle detection section 273 is arranged to detect and store the crank angle in the engine stop state, or detect the crank angle in the engine stop state after the engine start. Delay period adjusting section 274 is arranged to adjust the delay period in accordance with the crank angle representing a piston position. In the following embodiments, crank angle detection section 273 and delay period adjusting section 274 also compose the start control system or apparatus of the present invention.

Figure 10:
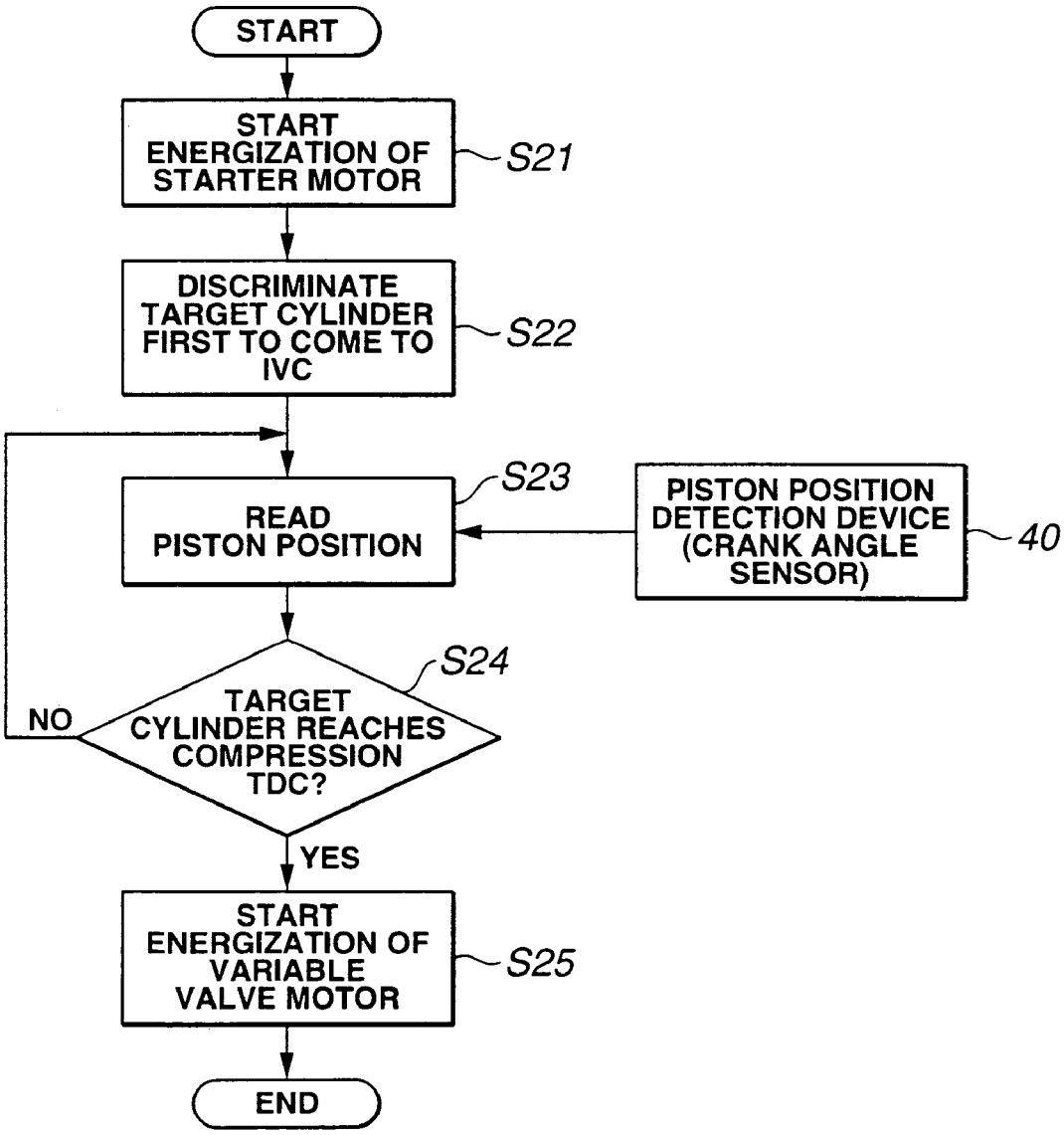
FIG. 10 is a flowchart showing an engine start control according to a second embodiment of the present invention.

FIG. 10 is a flowchart showing an engine start control according to a second embodiment of the present invention. This routine is performed in accordance with detection of an engine start request made by engine start request input means, such as an operation of the ignition key. First, in S21, an electric supply to starter motor 10 is started, and thereby cranking is commenced. In S22, a target cylinder first to come to an IVC is discriminated in accordance with the crank angle location in the engine stop state. In S23, a piston position of the target cylinder is read in accordance with the detection signal from crank angle sensor 40. In S24, it is determined whether or not the piston position of the target cylinder reaches a compression TDC. When it is determined in S24 that the piston position of the target cylinder reaches the compression TDC, the routine of FIG. 10 proceeds to S25. In S25, an electric supply to variable valve motor 26 of variable valve operating mechanism 20 is started. Thereby, a valve lift characteristic of each of intake valves 2 is controlled to assume the predetermined medium-lift/angle characteristic (in which the IVC is set in proximity of an intake bottom dead center) suitable for the cranking (valve operation start control part). In this second embodiment, the above-mentioned delay period is a period from the engine start until the compression TDC is reached by the piston position of the target cylinder first to come to the IVC.

According to this second embodiment, not only similar effects as in the first embodiment are achieved, but the electric supply to variable valve motor 26 is not started until the compression TDC is reached by the piston position of the target cylinder first to come to the IVC. Therefore, the internal combustion engine of this embodiment can surely avoid an excessive increase in electric power to be consumed by starter motor 10 and variable valve motor 26, and thus can secure a stable engine startability.

Figure 11:
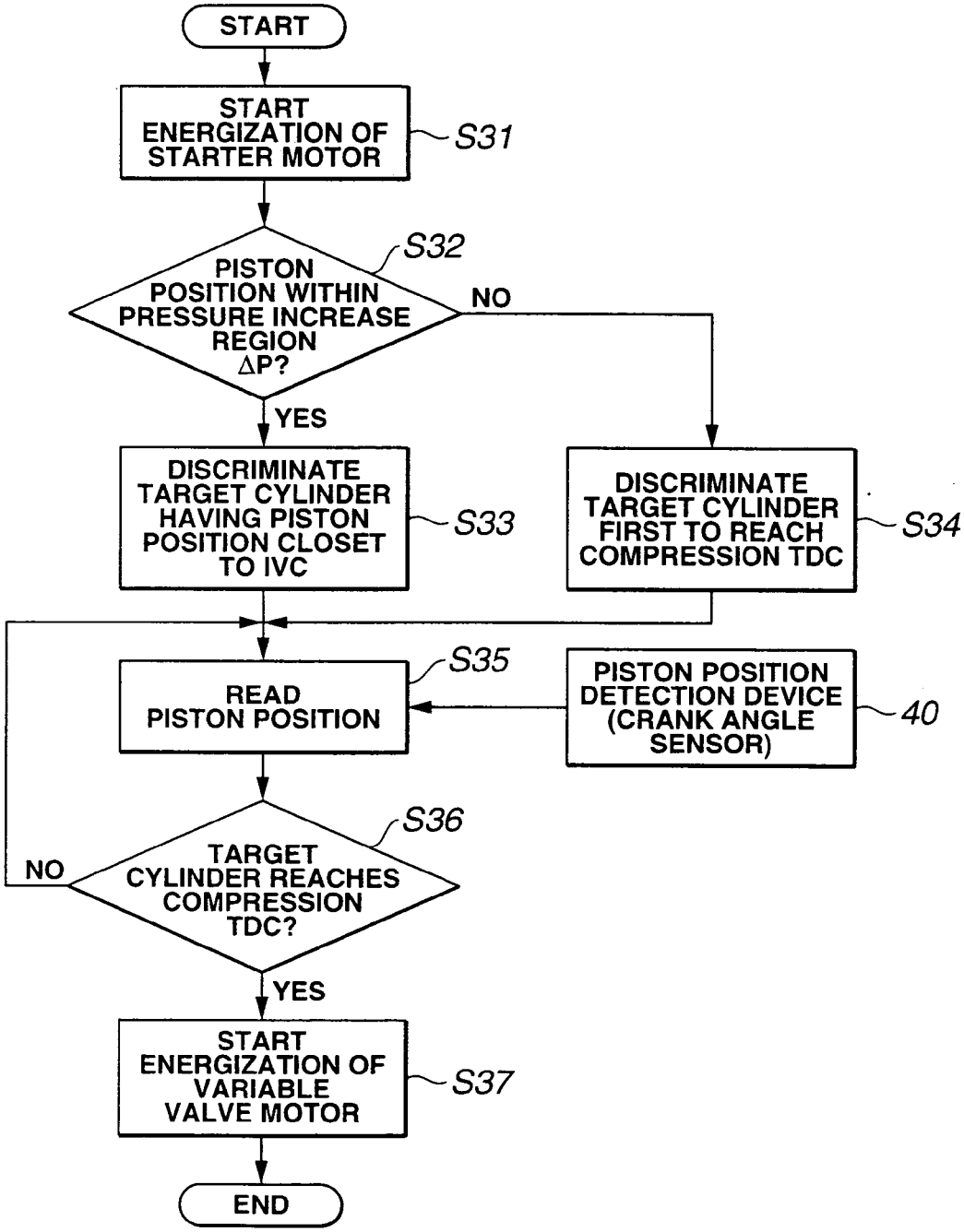
FIG. 11 is a flowchart showing an engine start control according to a third embodiment of the present invention.

FIG. 11 is a flowchart showing an engine start control according to a third embodiment of the present invention. This routine is performed in accordance with an engine start request. First, in S31, an electric supply to starter motor 10 is started, and thereby cranking is commenced. In S32, it is determined whether or not any of the cylinders has the piston positioned within a region starting from an IVC toward an intake bottom dead center. That is, it is determined whether or not a piston position of any of the cylinders is within pressure increase region ΔP. When it is determined in S32 that any of the cylinders has a piston position within pressure increase region ΔP, the routine of FIG. 11 proceeds to S33. In S33, one of the cylinders having a piston position closest to the IVC is set to be a target cylinder. When it is determined in S32 that none of the cylinders has a piston position within pressure increase region ΔP, the routine of FIG. 11 proceeds to S34. In S34, one of the cylinders first to reach a compression TDC is discriminated and set to be a target cylinder.

In S35, a piston position of the target cylinder set in S33 or S34 is read one by one in accordance with the detection signal from a piston position detection device, such as crank angle sensor 40. In S36, it is determined whether or not the piston position of the target cylinder reaches a compression TDC. When it is determined in S36 that the piston position of the target cylinder reaches the compression TDC, the routine of FIG. 11 proceeds to S37. In S37, an electric supply to variable valve motor 26 is started. Thereby, a valve timing (a valve opening/closing characteristic) of each of intake valves 2 is controlled to assume the medium-lift/angle characteristic suitable for the cranking (valve operation start control part). That is, when any of the cylinders has a piston position within pressure increase region ΔP, the above-mentioned delay period is a period from the engine start until the target cylinder reaches the compression TDC. When none of the cylinders has a piston position within pressure increase region ΔP, the above-mentioned delay period is a period from the engine start until either of the cylinders reaches the compression TDC. In the example in FIGS. 1 and 2, controller 27 also includes a cylinder discrimination section 275. Cylinder discrimination section 275 is arranged to determine whether or not any of the cylinders is stopped at a piston position within pressure increase region ΔP in the engine stop state, and discriminate one of the cylinders having the piston position closest to the IVC when more than one of the cylinders are each stopped at the piston position within pressure increase region ΔP in the engine stop state. In this embodiment, cylinder discrimination section 275 also forms a part of the start control system or apparatus of the present invention.

According to this third embodiment, in accordance with the crank angle location, i.e., a piston position in each of the cylinders, in the engine stop state, it is determined whether or not any of the cylinders has the piston position within pressure increase region ΔP, i.e., any of the cylinders has the maximum pressure to exceed reference value B0 (S32). Then, when it is determined that any of the cylinders has the maximum pressure to exceed reference value B0, the electric supply to variable valve motor 26 is started after the target cylinder undergoes the maximum pressure at the compression TDC. When it is determined that none of the cylinders has the maximum pressure to exceed reference value B0, the electric supply to variable valve motor 26 is started after either of the cylinders reaches the compression TDC for the first time. Therefore, the internal combustion engine of this embodiment not only can avoid an excessive increase in electric power to be consumed by starter motor 10 and variable valve motor 26, but can shorten the delay period in accordance with the crank angle in the engine stop state, and thus can secure a responsive engine startability.

Besides, S33 of FIG. 11 is performed for a case where there are more than one of the cylinders each of which is stopped at the piston position within pressure increase region ΔP in the engine stop state, such as when the internal combustion engine includes a number of cylinders such as in eight, twelve or sixteen cylinders. In this case, one of the cylinders having the piston position closest to the IVC, i.e., having the piston position farthest from the compression TDC, is set to be the target cylinder. Therefore, even when more than one of the cylinders each of which has the maximum pressure to exceed reference value B0, the electric supply to variable valve motor 26 is not started until all of the cylinders having the maximum pressure higher than reference value B0 undergo the maximum pressure at the compression TDC.

When the piston is positioned at the compression TDC upon actually energizing variable valve motor 26, the piston is soon pushed back from the compression TDC to exert a force to rotate the crankshaft forward. This forward force reduces a load on starter motor 10. Therefore, at the compression TDC, electric power can be consumed by variable valve motor 26 without causing trouble. Besides, the electric supply to variable valve motor 26 may be started immediately after the compression TDC. In this case, pressure in the cylinder acts to rotate the crankshaft forward. Thus, within a predetermined crank angle range from a timing immediately after the compression TDC until a timing when the pressure in the cylinder equals atmospheric pressure, the pressure in the cylinder acts to rotate the crankshaft forward. Therefore, the internal combustion engine of this embodiment can reduce a load on starter motor 10.

Variable valve operating mechanism 20 of the above-described embodiments is a variable lift/angle mechanism capable of continuously varying both a valve lift amount and an operative angle of each of the intake valves. However, a variable phase mechanism arranged to vary a valve timing (a valve opening/closing characteristic) of each of the intake valves by varying rotational phases of a crankshaft and a camshaft may be used alone, or in combination, as the variable valve operating mechanism.

According to another aspect of the present invention, the start control system or apparatus includes: means (10, 50, S11, S21, S31) for performing a cranking operation of cranking the internal combustion engine in response to a request for an engine start; means (20, 26, 271, S13, S25, S37) for performing a shifting operation of shifting an intake valve closing timing toward an intake bottom dead center after a start of the cranking operation; and means (272, S12, S22~24, S32~36) for delaying a start of the shifting operation (20, 26, 271, S13, S25, S37) from the start of the cranking operation (10, 50, S11, S21, S31) by a predetermined delay period.

This application is based on a prior Japanese Patent Application No. 2003-426619 filed on Dec. 24, 2003. The entire contents of this Japanese Patent Application No. 2003-426619 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A start control apparatus for an internal combustion engine, comprising:

a cranking actuating section to perform an energization of a starter motor in response to a request for an engine start and thereby perform a cranking of the internal combustion engine;

a valve operation start control section to perform an energization of an electric variable valve motor during the cranking and thereby activate a variable valve operating mechanism to control a valve opening/closing characteristic to a condition designed to promote the cranking; and a delay control section to delay a timing of starting the energization of the electric variable valve motor from a timing of starting the energization of the starter motor at least by a predetermined delay period, to start the energization of the electric variable valve motor during the cranking to promote the cranking, after expiration of the predetermined delay period.

2. A start control apparatus for an internal combustion engine, comprising:

a cranking actuating section to perform an energization of a starter motor in response to a request for an engine start and thereby perform a cranking of the internal combustion engine;

a valve operation start control section to perform an energization of an electric variable valve motor and thereby activate a variable valve operating mechanism to control a valve opening/closing characteristic to a condition designed to promote the cranking; and a delay control section to delay a timing of starting the energization of the electric variable valve motor from a timing of starting the energization of the starter motor at least by a predetermined delay period, wherein the variable valve operating mechanism is biased by a spring force of a valve spring toward a direction to shift the valve opening/closing characteristic to a condition in which an intake valve closing timing in an engine stop state is at an advance angle from an intake bottom dead center.

3. The start control apparatus as claimed in claim 2, wherein the delay period is a fixed value equivalent to a period from the intake valve closing timing to a compression top dead center with a valve opening/closing characteristic for the engine stop state.

4. The start control apparatus as claimed in claim 2, further comprising:

a crank angle detection section to detect a crank angle in the engine stop state; and a delay period adjusting section to adjust the delay period in accordance with the crank angle in the engine stop state.

5. The start control apparatus as claimed in claim 4, wherein the crank angle detection section is arranged to store the detected crank angle in the engine stop state, and the delay period adjusting section is arranged to adjust the delay period in accordance with the stored crank angle in the engine stop state.

6. The start control apparatus as claimed in claim 4, further comprising a crank angle sensor to sense a crank angle in the engine stop state; wherein the crank angle detection section is arranged to detect the crank angle in the engine stop state in accordance with a detection signal from the crank angle sensor, and the delay period adjusting section is arranged to obtain a piston position of a cylinder in accordance with the crank angle in the engine stop state, and adjust the delay period in accordance with the piston position of the cylinder.

7. The start control apparatus as claimed in claim 4, wherein the crank angle detection section is arranged to detect a crank angle in the engine stop state after the engine start.

8. The start control apparatus as claimed in claim 4, wherein the delay period is set equal to a period from a start of the internal combustion engine until a compression top dead center is reached by a piston position of a cylinder first to come to the intake valve closing timing.

9. The start control apparatus as claimed in claim 4, further comprising a cylinder discrimination section to determine whether or not any cylinder of the engine is stopped at a piston position within a pressure increase region in the engine stop state, the pressure increase region ranging from the intake valve closing timing to a timing advanced from the intake bottom dead center by a crank angle from the intake valve closing timing to the intake bottom dead center; wherein, when the cylinder discrimination section determines that one of the cylinders is stopped at the piston position within the pressure increase region in the engine stop state, the delay period is set equal to a period from the start of the internal combustion engine until the one of the cylinders reaches a compression top dead center, and when the cylinder discrimination section determines that none of the cylinders is stopped at the piston position within the pressure increase region in the engine stop state, the delay period is set equal to a period from the start of the internal combustion engine until either of the cylinders reaches the compression top dead center.

10. The start control apparatus as claimed in claim 9, wherein the cylinder discrimination section is arranged to discriminate one of the cylinders having the piston position closest to the intake valve closing timing when the cylinder discrimination section determines that a plurality of the cylinders are each stopped at the piston position within the pressure increase region in the engine stop state; and the delay period is set equal to a period from the start of the internal combustion engine until the discriminated one of the cylinders reaches the compression top dead center.

11. A start control process for an internal combustion engine, comprising:

performing an energizing operation of a starter motor in response to a request for an engine start and thereby performing a cranking of the internal combustion engine;

performing an energizing operation of an electric variable valve motor during the cranking of the internal combustion engine and thereby activating a variable valve operating mechanism to control a valve opening/closing characteristic to a condition designed to promote the cranking; and delaying a start of the energizing operation of the electric variable valve motor from a start of the energizing operation of the starter motor at least by a predetermined delay period so that the energizing operation of the electric variable valve motor is started during the cranking after the start of the energizing operation of the starter motor.

12. A start control apparatus for an internal combustion engine, comprising:

means for performing a cranking operation of cranking the internal combustion engine in response to a request for an engine start;

means for performing a shifting operation of shifting an intake valve closing timing toward an intake bottom dead center after a start of the cranking operation; and means for delaying a start of the shifting operation from the start of the cranking operation by a predetermined delay period.

* * * * *